US010017701B2

(12) United States Patent
Meyer

(10) Patent No.: US 10,017,701 B2
(45) Date of Patent: Jul. 10, 2018

(54) FLARE ELIMINATION PROCESS AND METHODS OF USE

(71) Applicant: Aspen Engineering Services, LLC, Golden, CO (US)

(72) Inventor: James M Meyer, Golden, CO (US)

(73) Assignee: ASPEN ENGINEERING SERVICES, LLC, Golden, CO (US)

( * ) Notice: Subject to any disclaimer, the term of this patent is extended or adjusted under 35 U.S.C. 154(b) by 429 days.

(21) Appl. No.: 14/719,044

(22) Filed: May 21, 2015

(65) Prior Publication Data

US 2015/0344788 A1 Dec. 3, 2015

Related U.S. Application Data

(60) Provisional application No. 62/006,425, filed on Jun. 2, 2014.

(51) Int. Cl.

| | |
|---|---|
| ***B01D 19/00*** | (2006.01) |
| ***C10G 5/06*** | (2006.01) |
| ***C10L 3/10*** | (2006.01) |

(52) U.S. Cl.

CPC ..... *C10G 5/06* (2013.01); *C10L 3/101* (2013.01); *C10G 2300/1025* (2013.01); *C10L 3/107* (2013.01); *C10L 2290/06* (2013.01); *C10L 2290/46* (2013.01); *C10L 2290/48* (2013.01); *C10L 2290/543* (2013.01)

(58) Field of Classification Search

None

See application file for complete search history.

(56) References Cited

U.S. PATENT DOCUMENTS

| | | | | |
|---|---|---|---|---|
| 3,971,719 | A | 7/1976 | Peters | |
| 5,302,294 | A * | 4/1994 | Schubert | B01D 17/02 210/188 |
| 6,537,458 | B1 | 3/2003 | Polderman | |
| 7,051,553 | B2 | 5/2006 | Mak et al. | |
| 2002/0065446 | A1* | 5/2002 | Wilkinson | C07C 7/005 585/802 |
| 2004/0148964 | A1* | 8/2004 | Patel | C07C 7/005 62/620 |
| 2004/0206112 | A1* | 10/2004 | Mak | F25J 3/0209 62/617 |
| 2009/0031756 | A1 | 2/2009 | Betting et al. | |
| 2010/0043488 | A1 | 2/2010 | Mak et al. | |
| 2010/0206003 | A1* | 8/2010 | Mak | F25J 3/0209 62/630 |

(Continued)

*Primary Examiner* — Amber R Orlando
*Assistant Examiner* — Phillip Y Shao
(74) *Attorney, Agent, or Firm* — Thorpe North & Western, LLP.

(57) ABSTRACT

Rich natural gas is first compressed, then ambient air cooled and separated into lean natural gas, NGL and water. Hydrate formation during decompression of the lean gas is precluded by either heating the lean natural gas or mixing the lean natural gas with methanol or other additive before depressurization. Similarly, hydrate formation in the NGL is also precluded by either heating the NGL or mixing the NGL with methanol or other additive before depressurization. The NGL is conditioned for storage and transport in common propane tanks by a stabilizer or two-phase separator. The lean natural gas can be used for internal combustion, liquefied natural gas, compressed natural gas or liquid fuel processing.

14 Claims, 4 Drawing Sheets

(56) References Cited

U.S. PATENT DOCUMENTS

| | | | | |
|---|---|---|---|---|
| 2010/0242536 | A1* | 9/2010 | Paradowski | B01D 53/002 62/621 |
| 2013/0333416 | A1* | 12/2013 | Lourenco | B01D 3/4211 62/611 |
| 2014/0174122 | A1 | 6/2014 | Cooper et al. | |

* cited by examiner

FLARE ELIMINATION PROCESS AND METHODS OF USE

RELATED APPLICATION

This application claims priority to and incorporates by reference U.S. Provisional Patent Application No. 62/006,425, filed Jun. 2, 2014 and having the same inventor as the present application.

FIELD OF INVENTION

This invention relates generally to hydrocarbon recovery from rich natural gas.

BACKGROUND

The combination of horizontal drilling and fracking has caused an oil boom across the United States. Most notably, the Bakken oil field of North Dakota has grown tremendously in recent years. Flaring from crude oil operations in the Bakken has become an enormous economic and environmental issue. Horizontal drilling and fracking co-produces natural gas. The co-produced gas is normally compressed and sent down a pipeline. However, in the Bakken, the pipeline infrastructure has failed to keep pace with drilling. Consequently, the associated natural gas is often flared. The 2700 wells that are flaring gas in the Bakken have created a problem so severe that it can be seen from space. Legislation to curtail flaring in the Bakken will limit oil production unless flaring alternatives are developed.

There are several known alternatives to flaring. First, lean natural gas—gas that has a small amount of propane and heavier hydrocarbons—can be used as a fuel for an internal combustion engine that, in turn, drives an electrical generator. The generated electricity can be used for local power or sold to the electrical grid. Second, the natural gas can be liquefied to form Liquefied Natural Gas (LNG). Third, natural gas can be compressed and sold as Compressed Natural Gas (CNG). Fourth, natural gas can be converted to liquid fuel including methanol. However, the associated gas produced from horizontal drilling and shale basins is rich gas, because the gas contains substantial amounts of heavier hydrocarbons including propane, butane, hexane, heptane and octane. The aforementioned hydrocarbons are known as Natural Gas Liquid (NGL).

Rich gas is unsuitable for the aforementioned flaring alternatives for three reasons. First, the heavier hydrocarbons cause the gas energy content to be too high for internal combustion. Specifically, the high energy content causes internal combustion engines to knock. Second, the heavier hydrocarbons in the rich gas interfere with methanol and other liquid fuel chemistry. Third, heavy hydrocarbons cause the LNG to be unsuitable for motor-fuel use.

SUMMARY OF THE INVENTION

The flare elimination process (FEP) described herein removes the valuable NGL hydrocarbons for sale and distribution while concurrently producing a lean natural gas suitable for various flaring alternatives. Embodiments of crude oil stabilization and recovery systems according to the present invention compress rich natural gas, then cool and partially condense the gas. A three-phase separator can be used to remove the lean natural gas and separate the water and NGL by decantation. Ice and hydrate formation are precluded by the addition of heat to the lean natural gas and the NGL before depressurization. The NGL is stabilized for storage and transport with a stabilizer tower or a two-phase separator. The stabilizer gas from the top of the stabilizer tower or two-phase separator can be recycled to the compressor to improve NGL recovery.

DETAILED DESCRIPTION

Figure 1:
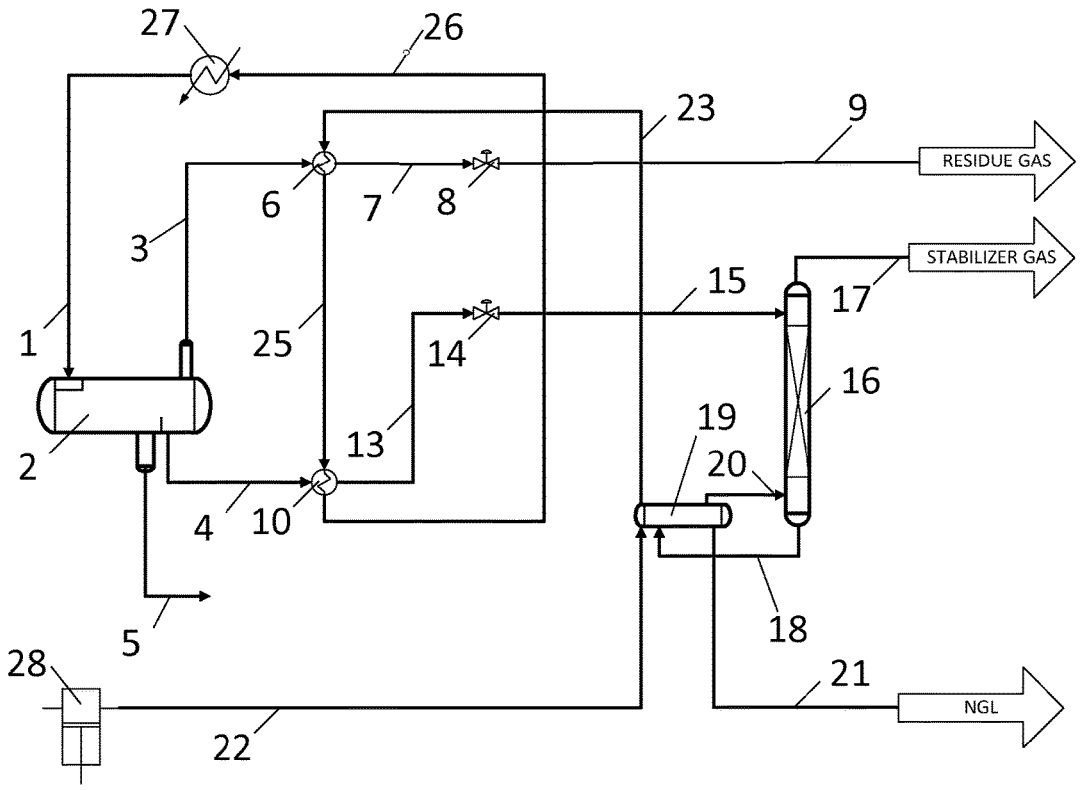
FIG. 1 is a process flow diagram for a FEP process using compression fluid in the hot side of the heat exchangers in accordance with one example variation of the present invention.

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "True Vapor Pressure (TVP)" means the vapor pressure of the NGL at 100° F.

The term "stabilized NGL" means natural gas liquid with a vapor pressure low enough to comply with regulations for transport and storage, which is typically less than 200 psia TVP.

The term "three-phase separator" means a vessel capable of separating a gas phase, hydrocarbon phase and aqueous phase into dedicated outlets.

The term "two-phase separator" means a vessel capable of separating a gas phase from a liquid phase into dedicated outlets.

The term "NGL" means hydrocarbon liquid condensed from the cooler.

The term "stabilizer" means a distillation column that removes light hydrocarbons from the NGL.

The term "cooler" means a heat exchanger cooled by air, water or other utility.

The term "compression fluid" means compressed gas, compressed two-phase gas and liquid or compressed three phase gas, hydrocarbon liquid and water.

The term "inter-stage compressor cooler" means a cooler between stages of compression.

The term "inter-stage compressor separator" means a two-phase separator between stages of compression.

The term "residue gas" means natural gas discharge from a three-phase separator.

The term "stabilizer gas" means gas removed from a stabilizer or two-phase separator.

The term "heating medium" means a fluid flowing through the hot side of a heat exchanger and includes, but is not limited to, compressed natural gas, glycol, water or hot oil.

Flare Elimination Process

The flare elimination process can include various steps. First, rich natural gas can be compressed. Second, the compressed gas can be cooled. Third, the cooled mixture of lean natural gas, NGL and water can be separated in a separator unit such as a three-phase separator. Fourth, heat can be added before NGL depressurization to stabilize the NGL and to prevent ice and hydrate formation. Alternatively, additives can be introduced to the NGL product to prevent ice and hydrate formation. Fifth, NGL liquid from the bottom of the separator can then be stabilized for storage and transfer in standard propane bullet tanks. Sixth, the lean natural gas from the three-phase separator can be depressurized, but only if required for downstream processing. If the lean natural gas is to be depressurized, hydrate formation can be precluded by heating the gas before depressurization. The heat source for both the NGL and lean natural gas heaters can be the compression fluid from the compressor discharge, or can be provided by dedicated heater units. The water leaving the three-phase separator can be either recycled or sent for disposal. An alternative process injects methanol or other antifreeze additive before depressurization. The antifreeze additive process does not require heaters.

The compressor can have one or more stages of compression, or a plurality of compressors can be used in series. When multiple reciprocal compressor stages are used, NGL condensation from the intermediate air coolers is minimized by temperature control on the coolers. If a flooded screw compressor is used, the gas is cooled by a cooler only after compression.

As outlined previously, the flare elimination system can include at least one separator fluidly connected downstream of an ambient air cooler. The separator can be adapted to receive a compression fluid. Although the system can be scaled to almost any size, the system finds particular application in installations having a compression fluid flow rate of less than about 5 million cubic feet per day, and in some cases less that about 4 million. The compression fluid typically include a residue gas, natural gas liquid (NGL), and water. The separator can be adapted to separate the residue gas, the NGL, and the water into separate flows. This can be accomplished in a single unit (e.g. a three-phase separator) or using multiple units. For example, a first two-phase separator can be used to separate the residue gas from liquids including the NGL and water. A second two-phase separator can then be used to separate the NGL from the water.

Regardless, an NGL upgrader can be disposed downstream of the separator. The NGL upgrader can receive the NGL. The NGL upgrader is configured to remove or produce a stabilizer gas from a top of the NGL upgrader while a hydrocarbon liquid can be removed from a bottom of the NGL upgrader.

Furthermore, the cooler can be disposed upstream of said at least one separator. The ambient air cooler can be sized and configured to cool the compressor fluid and deliver cooled compressor fluid to the separator unit. The ambient air cooler can be any cooler which uses ambient air as a cooling fluid rather than a compressed coolant (e.g. refrigerated or J-T cooling). Non-limiting examples of commercially available air coolers can include GEA, AXH, Chart and Harsco air coolers. In one example, the ambient air cooler can be adapted to cool the cooled compressor fluid to a temperature of 50° F. at a pressure of 800 psig. Typically, cooler outlet temperatures can range from 35 to 110° F. with pressures from 400 to 800 psig. In some cases, cooler outlet temperatures can range from 50 to 60° F. with pressures from 600 to 800 psig.

In one specific alternative, the flare elimination system can include a heat integration scheme which includes one or more heat exchangers operatively connected between outlets of the separator and the compression fluid. In this manner, heat from incoming compression fluid can be transferred to the residue gas and NGL. This integration of heat recovery provides a pre-cooling of the compression fluid which reduces cooling load on the cooler. Furthermore, such heat integration can reduce or eliminate formation of ice and nitrates and can provide additional heat for upgrading of the NGL product.

For example, a first heat exchanger can be disposed downstream of the separator receiving residue gas on a cold side of the first heat exchanger from the separator and receiving the compression fluid on a hot side of the first heat exchanger. An optional first valve can be disposed downstream of the first heat exchanger which first valve receives the residue gas from the first heat exchanger. A second heat exchanger can be disposed downstream of the separator receiving the NGL on a cold side of the second heat exchanger from the separator and receiving the compression fluid on a hot side of the second heat exchanger. Consequently, a second valve can be disposed downstream of the second heat exchanger to receive the NGL.

In lieu of a heat integration scheme or a portion thereof, the system can include dedicated heaters. For example, a first heater can be disposed downstream of the separator to heat the residue gas. Similarly, a second heater can be disposed downstream of the separator to heat the NGL. The heaters can be any standard heater and can include resistive heaters, burners, and the like. In yet another alternative, the above heat integration system of heat exchangers can be used, except a heating medium other than the compression fluid flows through one or more of the aforementioned heat exchangers, whereby compression fluid bypasses the heat exchangers.

The flare elimination system can optionally further include a third heat exchanger configured to receive the hydrocarbon liquid on a cold side of the third heat exchanger from the bottom of the NGL upgrader. The third heat exchanger can return a vaporized hydrocarbon to the NGL upgrader, deliver a stabilized NGL via an NGL product conduit, and receive the compression fluid on a hot side of the third heat exchanger. When the NGL upgrader is a stabilizer, the third heat exchanger functions as a reboiler.

Consistent with the above hat integration system, the compression fluid can be passed through one or more heat exchangers in sequence or parallel. For example, in one option, the compression fluid is coupled sequentially to the third heat exchanger, then the first heat exchanger, then the second heat exchanger, prior to the ambient air cooler. Optionally, the heating medium (i.e. compression fluid or dedicated heat transfer fluid) can be delivered sequentially to the second heat exchanger before the first and third heat exchangers. In yet another option, the heating medium can be delivered sequentially to the first heat exchanger before the second and third heat exchangers. However, the heating medium can also be delivered in parallel to any two or three of these heat exchangers.

In another optional aspect, methanol (or other additive) can be injected into the residue gas downstream of the separator such that a residue gas heat exchanger or other heater is not present prior to the NGL upgrader. Similarly, methanol or other similar additive can be injected into the NGL downstream of the separator such that an NGL heat exchanger or other heater is not present prior to the NGL upgrader.

The NGL upgrader can be used to separate NGL from other products such as a stabilizer gas. In one aspect, the NGL upgrader is a stabilizer. However, in some cases it can be suitable to use a simple two-phase separator as the NGL upgrader, particularly if ethane is to be sold with the NGL mixture. In another alternative, the stabilizer gas is not recycled to a compressor to reduce the compressor power requirement. This can be advantageous when additional downstream recovery systems are used for the stabilizer gas or when the stabilizer gas is delivered to a pipeline.

In another optional aspect, the three-phase separator receives liquid pumped from the compressor inter-stage scrubbers.

With this outline of the technology, the following exemplary embodiments illustrate several variations and implementations of the flare elimination process and system.

A First Embodiment of the Flare Elimination Process

Referring to FIG. 1, compression fluid 22 flows from compressor 28, typically at 200 to 250° F. and 600 to 800 psig, into the hot side of heat exchanger 19. Compression fluid 23 flows from heat exchanger 19 into the hot side of heat exchanger 6. Compression fluid 25 flows from heat exchanger 6 into the hot side of heat exchanger 10. Stream 26 flows from heat exchanger 10 into cooler 27. Compressed and cooled natural gas 1, typically at 50 to 100° F., flows from cooler 27 into three-phase separator 2.

Residue gas 3 flows from the top of three-phase separator 2. Residue gas 3 from three-phase separator 2 flows into the cold side of heat exchanger 6. The heated residue gas 7 from heat exchanger 6 flows into depressurization valve 8. Lean natural gas 9 from depressurization valve 8 can combusted as fuel, used to make CNG, LNG, or burned in a flare or other combustion device. An aqueous phase 5 flows from the bottom of three-phase separator 2, upstream of a weir.

NGL 4, typically at 50 to 100° F., flows from the bottom of three-phase separator 2, downstream of a weir. NGL 4 from three-phase separator 2 is heated in heat exchanger 10. The heated NGL 13 from heat exchanger 10, typically at 100 to 175° F., flows through depressurization valve 14. The depressurized NGL 15 from depressurization valve 14, typically at 150 to 200 psig, flows into stabilizer 16. Stabilizer gas 17 from the top of stabilizer 16 is recycled to the compressor. Hydrocarbon 18 from the bottom of stabilizer 16 is partially vaporized in heat exchanger 19. Vaporized hydrocarbon 20 is returned to stabilizer 16. Stabilized NGL 21 flows from the bottom of heat exchanger 19.

A Second Embodiment of the Flare Elimination Process

Figure 2:
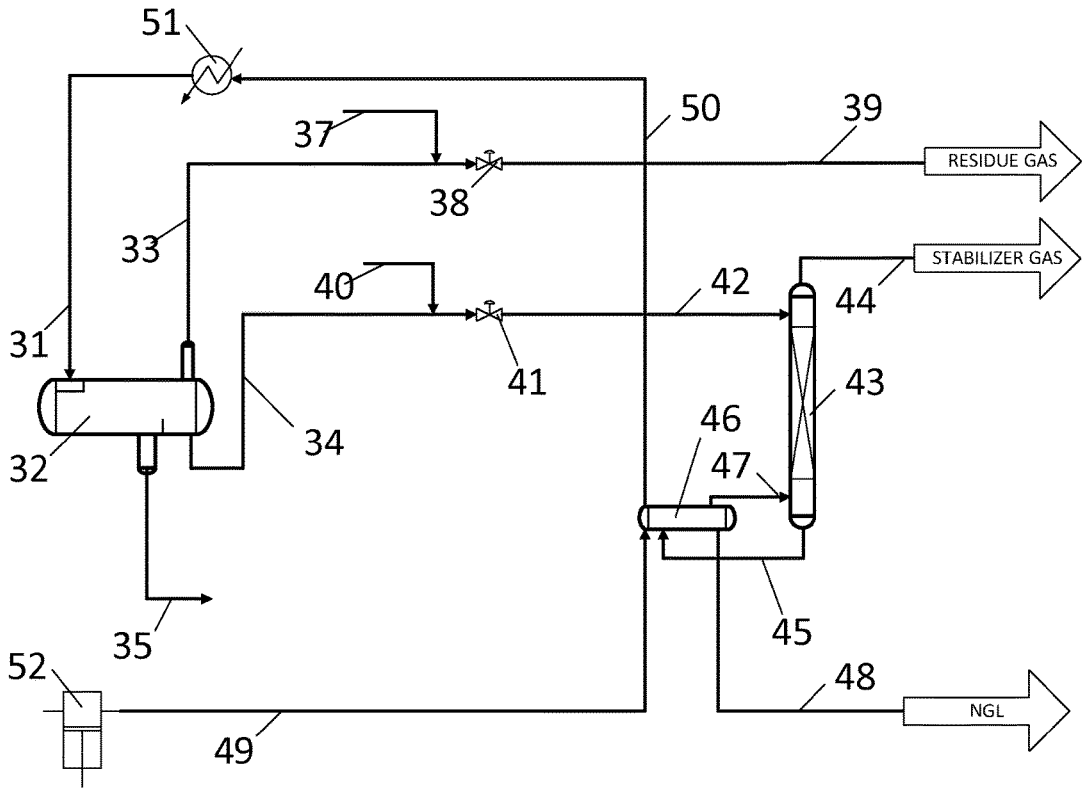
FIG. 2 is a process flow diagram for a FEP process using an antifreeze injection upstream of the residue gas and NGL depressurization valves in accordance with another example variation of the present invention.

Referring now to FIG. 2, compression fluid 49 flows from compressor 52, typically at 200 to 250° F. and 600 to 800 psig, into the hot side of heat exchanger 46. Stream 50 flows from heat exchanger 46 into cooler 51. Compressed and cooled natural gas 31, typically at 50 to 100° F., flows from cooler 51 into three-phase separator 32.

Residue gas 33 flows from the top of three-phase separator 32 and is mixed with antifreeze additives 37 before flowing into depressurization valve 38. Residue gas 39 from valve 38 can combusted as fuel, used to make CNG, LNG, or burned in a flare or other combustion device. An aqueous phase 35 flows from the bottom of three-phase separator 2, upstream of a weir.

NGL 34, typically at 50 to 100° F., flows from the bottom of three-phase separator 32, downstream of a weir and is mixed with antifreeze additives 40 before flowing into depressurization valve 41. The depressurized NGL 42 from depressurization valve 41, typically at 150 to 200 psig, flows into stabilizer 43. Stabilizer gas 44 from the top of stabilizer 43 is recycled to the compressor. Hydrocarbon 45 from the bottom of stabilizer 43 is partially vaporized in heat exchanger 46. Vaporized hydrocarbon 47 is returned to stabilizer 43. Stabilized NGL 48 flows from the bottom of heat exchanger 46.

A Third Embodiment of the Flare Elimination Process

Figure 3:
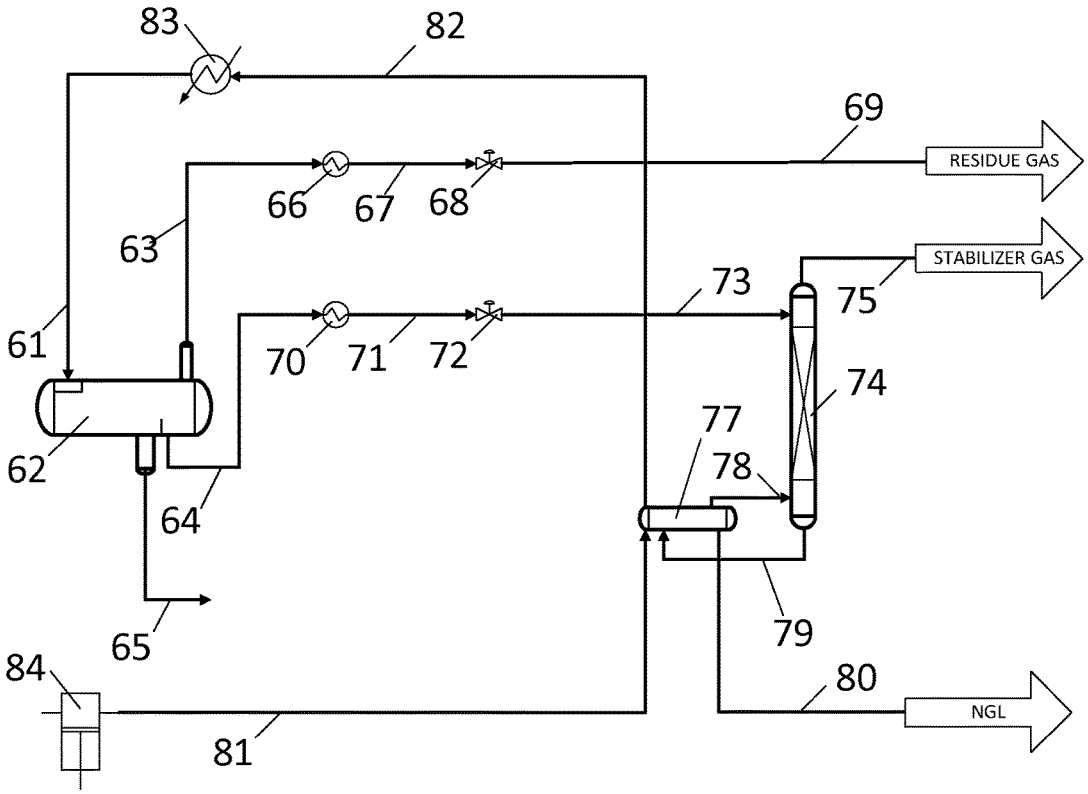
FIG. 3 is a process flow diagram for a FEP process using heaters upstream of the residue gas and NGL depressurization valves in accordance with yet another example variation of the present invention.

Referring to FIG. 3, compression fluid 81 flows from compressor 84, typically at 200 to 250° F. and 600 to 800 psig, into the hot side of heat exchanger 77. Stream 82 flows from heat exchanger 77 into cooler 83. Compressed and cooled natural gas 61, typically at 50 to 100° F., flows from cooler 83 into three-phase separator 62.

Residue gas 63 flows from the top of three-phase separator 62 into heater 66. The heated residue gas 67 from heater 66 flows into depressurization valve 68. Residue gas 69 from valve depressurization 68 can combusted as fuel, used to make CNG, LNG, or burned in a flare or other combustion device. An aqueous phase 65 flows from the bottom of three-phase separator 62, upstream of a weir.

NGL 64, typically at 50 to 100° F., flows from the bottom of three-phase separator 62, downstream of a weir. NGL 64 from three-phase separator 62 is heated in heater 70. The heated NGL 71 from heater 70, typically at 100 to 175° F., flows through depressurization valve 72. The depressurized NGL 73 from depressurization valve 72, typically at 150 to 200 psig, flows into stabilizer 74. Stabilizer gas 75 from the top of stabilizer 74 is recycled to the compressor. Hydrocarbon 79 from the bottom of stabilizer 74 is partially vaporized in heat exchanger 77. Vaporized hydrocarbon 78 is returned to stabilizer 74. Stabilized NGL 80 flows from the bottom of heat exchanger 77.

Alternative Embodiments and Variations

The various embodiments and variations thereof, illustrated in the accompanying figure and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For some embodiments, the heat exchangers are replaced by electrical, fired or frictional heaters. Other embodiments may use methanol injection in lieu of the heat exchangers to prevent hydrate formation. Some embodiments use a different sequence of heating medium flow through the heat exchangers, or deliver the heating medium flow in parallel through the heat exchangers.

An alternate embodiment uses a two-phase separator instead of a stabilizer column to separate NGL from recycled gas. Another alternative does not recycle stabilizer gas, but use the gas for other purposes such as combustion fuel. Another embodiment delivers the stabilizer gas to a refrigeration or Joule-Thompson cooling system for additional NGL recovery.

Figure 4:
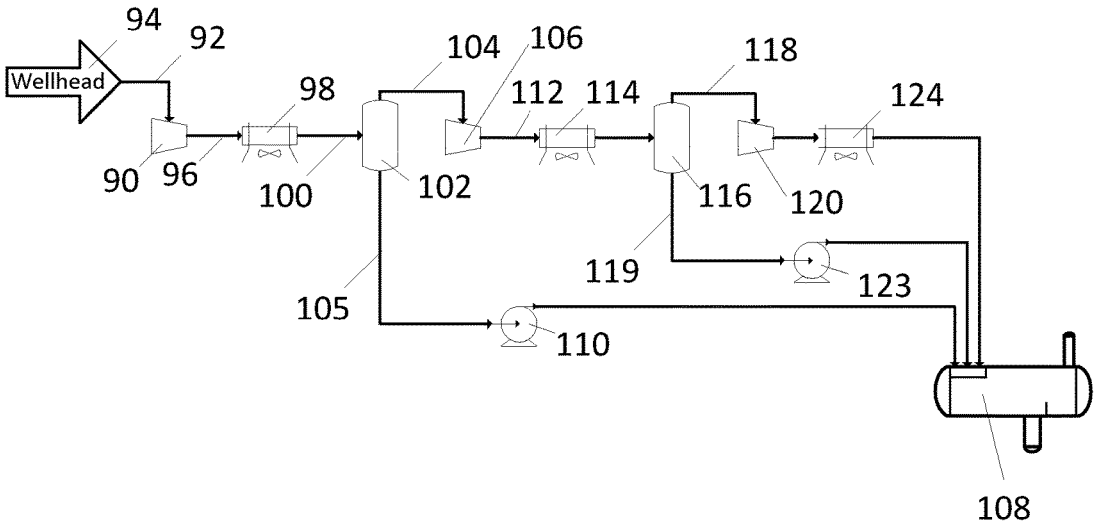
FIG. 4 is a process flow diagram of an alternative interstage scrubber system upstream of the separator in accordance with one example variation of the present invention.

Some embodiments may use a pump to transfer condensed liquids from the inter-stage compressor scrubbers to the three-phase separator. For example, FIG. 4 illustrates a compressor-scrubber unit which can be fluidly connected to the separator (e.g. any one of the above-described embodiments). More specifically, a first compressor 90 can receive fluids 92 directly from a wellhead 94. Compressed fluid 96 can be directed to a first ambient air cooler 98 to form a partially cooled compressed fluid 100. The partially cooled compressed fluid 100 can be directed to a first scrubber 102 where non-condensed fluids 104 are directed to a second compressor 106 and condensed cooled fluid 105 can be sent to the separator 108 via pump 110. Compressed fluid 112 from second compressor 106 can be directed to a second air cooler 114 and then to a second scrubber 116. Similar to the first stage, non-condensed fluids 118 can be directed to a third compressor 120, while condensed fluids 119 can be directed to the separator 108 via pump 123. Non-condensed fluids 118 from the second scrubber 116 can then be cooled using a third air cooler 124, and also sent to the separator 108. This staged scrubbing-condensing can be repeated (e.g. typically including 2-4 scrubber and condenser inter-stage units in series) and the units sized sufficient to provide a cooled compressed fluid to the separator 108.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

I claim:

1. A flare elimination system comprising:

at least one separator fluidly connected downstream of an ambient air cooler and adapted to receive a compression fluid including a residue gas, natural gas liquid (NGL), and water and to separate the residue gas, the NGL, and the water into separate flows;

an NGL upgrader disposed downstream of said at least one separator receiving the NGL, configured to remove a stabilizer gas from a top of said NGL upgrader and a hydrocarbon liquid from a bottom of said NGL upgrader;

wherein the cooler is disposed upstream of said at least one separator, configured to cool said compressor fluid and deliver cooled compressor fluid to the at least one separator;

a first heat exchanger disposed downstream of said at least one separator receiving residue gas on a cold side of said first heat exchanger from said at least one separator and receiving the compression fluid on a hot side of said first heat exchanger;

a first valve disposed downstream of said first heat exchanger receiving the residue gas from said first heat exchanger;

a second heat exchanger disposed downstream of said at least one separator receiving the NGL on a cold side of said second heat exchanger from said at least one separator and receiving the compression fluid on a hot side of said second heat exchanger; and a second valve disposed downstream of said second heat exchanger receiving the NGL from said second heat exchanger.

2. A flare elimination system of claim 1, wherein the at least one separator is a three-phase separator.

3. A flare elimination system of claim 1, wherein the at least one separator includes a set of two two-phase separators.

4. A flare elimination system of claim 1, wherein a heating medium other than compression fluid flows through one or more of said heat exchangers, whereby compression fluid bypasses said heat exchangers.

5. A flare elimination system of claim 1, further comprising a third heat exchanger configured to receive the hydrocarbon liquid on a cold side of said third heat exchanger from the bottom of said NGL upgrader, return a vaporized hydrocarbon to said NGL upgrader, deliver a stabilized NGL via an NGL product conduit, and receive the compression fluid on a hot side of said third heat exchanger.

6. A flare elimination system of claim 5, wherein the compression fluid is coupled sequentially to said third heat exchanger, then said first heat exchanger, then said second heat exchanger, and then said cooler.

7. A flare elimination system of claim 5, wherein heating medium is delivered sequentially to said second heat exchanger before said first and third heat exchangers.

8. A flare elimination system of claim 5, wherein heating medium is delivered sequentially to said first heat exchanger before said second and third heat exchangers.

9. A flare elimination system of claim 5, wherein heating medium is delivered in parallel to two of said heat exchangers.

10. A flare elimination system of claim 5, wherein heating medium is delivered in parallel to three of said heat exchangers.

11. A flare elimination system of claim 1, wherein said NGL upgrader is a stabilizer.

12. A flare elimination system of claim 1, wherein said NGL upgrader is a two-phase separator.

13. A flare elimination system of claim 1, wherein said stabilizer gas is not recycled to a compressor.

14. A flare elimination system of claim 1, wherein said residue gas does not flow through a heat exchanger.

* * * * *